US005964289A

United States Patent [19]

Hill

[11] Patent Number: 5,964,289

[45] Date of Patent: Oct. 12, 1999

[54] MULTIPLE ZONE WELL COMPLETION METHOD AND APPARATUS

[76] Inventor: Gilman A. Hill, 7128 S. Poplar La., Englewood, Colo. 80112

[21] Appl. No.: 09/006,928

[22] Filed: Jan. 14, 1998

Related U.S. Application Data

[60] Provisional application No. 60/035,491, Jan. 14, 1997.

[51] Int. Cl.[6] ..... E21B 43/26

[52] U.S. Cl. ..... 166/250.1; 166/281; 166/308

[58] Field of Search ..... 166/250.1, 270, 166/400, 280, 281, 308

[56] References Cited

U.S. PATENT DOCUMENTS

| | | | |
|---|---|---|---|
| 2,693,854 | 11/1954 | Abendroth | 166/15 |
| 2,838,117 | 6/1958 | Clark, Jr. et al. | 166/42 |
| 2,848,052 | 8/1958 | Stinson | 166/42 |
| 2,851,109 | 9/1958 | Spearow | 166/177 |
| 2,935,129 | 5/1960 | Allen et al. | 166/42 |
| 3,032,104 | 5/1962 | O'Reilly | 166/35 |
| 3,139,139 | 6/1964 | Elkins | 166/42 |
| 3,280,912 | 10/1966 | Sheffield, Jr. | 166/29 |
| 3,428,129 | 2/1969 | Cook | 166/292 |
| 3,730,276 | 5/1973 | Land | 166/314 |
| 3,825,071 | 7/1974 | Veatch, Jr. | 166/308 |
| 3,878,884 | 4/1975 | Raleigh | 165/1 |
| 3,933,205 | 1/1976 | Kiel | 166/308 |
| 3,965,982 | 6/1976 | Medlin | 166/249 |
| 4,068,718 | 1/1978 | Cooke, Jr. et al. | 166/280 |
| 4,078,609 | 3/1978 | Pavlich | 166/271 |
| 4,109,721 | 8/1978 | Slusser | 166/280 |
| 4,186,802 | 2/1980 | Perlman | 166/280 |
| 4,391,337 | 7/1983 | Ford et al. | 175/4.6 |
| 4,456,069 | 6/1984 | Vigneri | 166/303 |
| 4,633,951 | 1/1987 | Hill et al. | 166/308 |
| 4,640,355 | 2/1987 | Hong et al. | 166/269 |
| 4,678,037 | 7/1987 | Smith | 166/299 |
| 4,683,943 | 8/1987 | Hill et al. | 166/63 |
| 4,687,061 | 8/1987 | Uhri | 166/308 |
| 4,714,115 | 12/1987 | Uhri | 166/308 |
| 4,718,493 | 1/1988 | Hill et al. | 166/308 |
| 4,823,875 | 4/1989 | Hill | 166/280 |
| 4,852,650 | 8/1989 | Jennings et al. | 166/250 |
| 4,869,322 | 9/1989 | Vogt et al. | 166/280 |
| 4,887,670 | 12/1989 | Lord et al. | 166/281 |
| 4,893,676 | 1/1990 | Hill | 166/280 |
| 4,917,188 | 4/1990 | Fitzpatrick, Jr. | 166/295 |
| 4,938,286 | 7/1990 | Jennings, Jr. | 166/280 |
| 5,018,578 | 5/1991 | El Rabaa et al. | 166/281 |
| 5,036,918 | 8/1991 | Jenniengs, Jr. et al. | 166/263 |
| 5,036,919 | 8/1991 | Thomas et al. | 166/271 |
| 5,056,598 | 10/1991 | Jennings, Jr. | 166/308 |
| 5,159,979 | 11/1992 | Jennings, Jr. | 166/280 |
| 5,161,618 | 11/1992 | Jones et al. | 166/308 |
| 5,273,115 | 12/1993 | Spafford | 166/281 |
| 5,295,545 | 3/1994 | Passamaneck | 166/299 |
| 5,314,020 | 5/1994 | Jennings, Jr. et al. | 166/281 |
| 5,355,802 | 10/1994 | Petitjean | 102/313 |
| 5,358,047 | 10/1994 | Himes et al. | 166/280 |
| 5,417,287 | 5/1995 | Smith et al. | 166/308 |
| 5,441,110 | 8/1995 | Scott, III | 166/308 |
| 5,875,843 | 3/1999 | Hill . | |

*Primary Examiner*—Frank Tsay
*Attorney, Agent, or Firm*—Sheridan Ross P.C.

[57] ABSTRACT

The present invention discloses a system and method for completing a well for the collection of fluids from a plurality of subterranean zones at different depths. The system includes a fluid pathway along which a first and second fluid travel. The first and second fluids form an interface that is moved along the fluid pathway to cause the formation of a fracture in the zones. The pressure at any point along the fluid pathway depends upon the position of the interface.

25 Claims, 6 Drawing Sheets

MULTIPLE ZONE WELL COMPLETION METHOD AND APPARATUS

The present application claims priority from copending U.S. Provisional Application Ser. No. 60/035,491 entitled "MULTIPLE ZONE WELL COMPLETION METHOD AND APPARATUS" filed on Jan. 14, 1997, which is incorporated herein by this reference.

FIELD OF THE INVENTION

The present invention relates generally to a method and apparatus for completing wells that collect valuable fluids from a subterranean zone, and, particularly, to a method and apparatus for fracturing multiple zones in oil and gas wells.

BACKGROUND OF THE INVENTION

Hydraulic fracturing is a technique used to increase the permeability of an oil or gas-bearing zone in a well by forming a large number of cracks, or fractures, in the zone through which oil or gas can travel. Each such identifiable "zone" generally includes sediments that may be of sedimentary origin. In hydraulically fracturing the zone, a fluid, typically compressible, is injected into a well and the pressure from the weight and/or compression of the fluid causes the zone to crack or fracture. A single well typically accesses multiple zones located at different depths. Each zone is injected with a granulated material (e.g., proppant) to fill and restrict closure of the fractures therein.

Most of the methods for hydraulically fracturing isolate other zones from the slurry so that the slurry contacts only the zone to be fractured. In one method, a production casing is cemented to the wall of the wellbore for wellbore stability and/or zone isolation from other fluid-producing sediments. The cemented casing is perforated at or near the formation face by using a wireline or similar device to position and ignite an explosive device, such as a perforating gun. Proppant laden slurries are injected into the casing at high pressure to flow through the casing perforations and hydraulically fracture the zone. In another method, part of the production casing is cemented to the wellbore with the part of the casing adjacent to the zones being uncemented. The individual zones are isolated by straddle packers, the casing perforated as described above and each zone hydraulically fractured.

The above-noted methods generally can fracture only one zone at a time which entails a repetition of a series of steps zone by zone. Such a multiplicity of steps not only is costly but also prolongs the time to drill and complete the well.

In the above-noted methods, the contacting of the slurry with one or more previously fractured zones, especially shallower zones, can impair the ability of the slurry to fracture another zone. To seal off fractured zones from the proppant-containing slurry, deeper zones can be fractured first and a bridge plug, straddle packer, or a layer of sand used to cover and seal the zone. The steps of positioning the bridge plug or straddle packers or adding and removing the sand, however, introduce additional steps into the already lengthy well completion process. It is also difficult to correctly position the bridge plug, straddle packers, or sand layer.

In the perforating step, additional complications can arise as it is often difficult to properly position the device adjacent to the zone to be fractured. If the perforations are improperly positioned, little, if any, of the zone would be fractured. For example, in wide zones (e.g., 5,000 to 10,000 feet) improper positioning of the perforations can cause the fractures to be concentrated in isolated portions of the zones that are adjacent to the casing perforations or have a weaker resistance to fracturing than other portions of the zone. The concentration of fractures in specific portions of the zones can reduce the ability of oil and/or gas in unfractured portions of the zone to flow into the well.

The time to complete a well by the numerous steps of the above-noted methods is considerable (e.g., several days) and can cause liquids in the slurry to "waterlog" the formation. The extended period to complete the well can permit the water in the fracturing slurry to enter into the zones. The presence of the water in the zone can decrease production of oil and/or gas from the zones.

After formation of the fractures by hydraulic fracturing techniques such as the above-noted methods, there are often problems with the filling of the fractures with a sufficient amount of a proppant (e.g., sand) to restrict closure of the fractures. If too little proppant is placed in the fractures, the fractures will close and the permeability of the zone will not be improved significantly. If too much proppant is injected into the well to ensure that the fractures are filled with proppant, an excess amount of proppant must generally be removed from the well which can entail great expense.

SUMMARY OF THE INVENTION

An objective of the present invention is to provide a reduced cost method for fracturing multiple zones in a well.

Another objective is to provide a method for fracturing multiple zones in a continuous process.

Another objective is to provide a method or fracturing multiple zones in an open wellbore. A related objective is to provide a method for fracturing multiple zones that does not require the production casing to be cemented or otherwise attached to the walls of the wellbore.

Another objective is to provide a method for fracturing multiple zones that does not require an explosive charge.

Another objective is to provide a method for fracturing multiple zones that seals fractured zones from unfractured zones. A related objective is to provide a method for fracturing multiple zones that does not seal previously fractured zones with a bridge plug, straddle packers, sand or some other granulated material.

Another objective is to provide a method that substantially uniformly fractures zones, especially tall (thick) zones.

Another objective is to provide a method that does not result in a sufficient amount of liquid being introduced into the zone to cause a decrease in the production of valuable fluids from the zone. A related objective is to provide a method that completes a well in a short period of time to reduce the amount of liquid introduced into the zone during hydraulic fracturing.

Another objective is to provide a method for filling a fracture with a sufficient amount of proppant to increase the permeability of the fracture. A related objective is to provide a method for filling a fracture with a proppant that reduces the amount of excess proppant to be removed from the well.

The present invention realizes one or more of the above objectives by providing a system and method for fracturing sediments that includes: (i) a wellbore (preferably an open-hole, uncemented wellbore) extending from an accessible upper end into a subterranean zone (e.g., from the too to the bottom of a multiplicity of zones to be fractured); (ii) a conduit (i.e., a casing) located within the wellbore, with the conduit extending from the accessible upper end of the wellbore (e.g., the surface of the ground) to a location below a portion of the zone to be fractured and communicating with an area between the wellbore and the conduit at a location at or below the portion of the zone to be fractured; (iii) a preferably continuous fluid pathway defined by the conduit and the area between the conduit and wellbore, with the fluid pathway contacting the portion of the zone to be fractured (e.g., the continuous fluid pathway can extend from the surface down the casing and up the annulus between the casing and the wellbore); (iv) a first fluid positioned along an upper portion of the fluid pathway in the annulus between the casing and the wellbore; and (v) a second fluid positioned along the fluid pathway in the conduit interior and in a lower portion of the annulus between the casing and the wellbore, with the second fluid having a different, preferably lower, density than the first fluid and forming an interface with the first fluid. In the system, the fluid pressure exerted on the zones to be fractured is varied by altering the position of the interface along the fluid pathway. At the interface between the first and second fluids, the pressure exerted on the adjacent zone to be fractured is commonly the maximum fluid pressure at any point along the fluid pathway.

To provide an effective fluid pathway for this purpose, the portion of the wellbore above the upper-most zone to be fractured is preferably isolated and sealed from the fluid pathway by a larger conduit or casing cemented in place leaving only the zone to be fractured as an open-hole wellbore constituting a part of the fluid pathway. The conduit is preferably a pipe or casing having an outer diameter smaller than the diameter of the wellbore.

Depending upon the application, the system can include additional components. The system can also include a sump hole below the bottom of the conduit for collecting casing wiper plugs and/or other objects circulated down the conduit.

In a related aspect of the invention, a method for completing a well for the collection of fluids from a plurality of zones at different depths is provided. The first zone is at greater depth than the second zone. The method provides the means for changing the position of the interface to a location along the fluid pathway adjacent to a second zone to produce a second fluid pressure in the second zone with the second fluid pressure being sufficient to form a fracture in the second zone. As noted, the second fluid pressure is preferably the maximum fluid pressure located along the fluid pathway and is equal to or greater than the pressure required to induce a fracture in the second zone.

The first fluid preferably has certain properties to cause fractures to form in the zone adjacent to the interface. Preferably, the first fluid has a pressure gradient along the fluid pathway that is substantially greater than the fracture extension pressure gradient of the sediments to be fractured. The sediments to be fractured include the first and second zones and as many other zones as desired. To yield this pressure gradient, the first fluid is in the form of a slurry containing suspended solid particles having a size smaller than about 300 mesh (Tyler) and a specific gravity no less than about 4.5 and preferably greater than about 5.0. Preferred solid particles include taconite, magnetite, steel shot (granules), galena, and derivatives and mixtures thereof. The first fluid is preferably a slurry, including a liquid, such as gelled water, gelled oil, and mixtures thereof in which the high density solid particles are suspended. The pressure gradient of the first fluid preferably ranges from about 1.0 to about 1.3 psi/ft.

Likewise, the second fluid should have certain properties to facilitate the positioning of the interface with its maximum fluid pressure along the fluid pathway. The second fluid preferably has a pressure gradient along the fluid pathway that is substantially less than the fracture extension pressure gradient of the sediments to be fractured. The second fluid may be a low density liquid such as water or oil or may be a compressible fluid or foam, including a gas, such as air, nitrogen, natural gas, and mixtures thereof. The pressure gradient of the second fluid preferably ranges from about 0.25 to about 0.44 psi/ft.

When the interface is positioned adjacent to the second (i.e., upper) zone, the fluid pressure on the first (i.e., lower) zone is generally insufficient to fracture the first zone.

To fracture the first and second zone, the interface is preferably moved from the first zone to the second zone and from the second zone to the first zone. The first zone is at a greater depth than the second zone. In this manner, a continuous method is provided for fracturing any number of zones.

To move the interface to a desired position, the relative rates of injection of the first and second fluids into the fluid pathway can be altered. During the fracturing of the zone, the first (i.e., upper) fluid is preferably injected into the annulus between the conduit and the vellbore wall, and the second (i.e., lower) fluid is preferably injected into the conduit. To ascertain the position of the interface along the fluid pathway, the method can include the step of monitoring the fluid pressure at a plurality of points in the fluid pathway.

Additional fluids can be introduced into the fluid pathway. A third fluid can be introduced into the fluid pathway having a density different from the first and second fluid densities, with the third fluid including a third proppant having a median size ranging from about 20 to about 60 mesh (Tyler) and more preferably ranging from about 40 to about 60 mesh (Tyler). A fourth fluid can also be introduced into the fluid pathway having a density different from the first, second, and third fluid densities. The fourth fluid preferably includes a fourth proppant having a median size ranging from about 12 to about 20 mesh (Tyler).

In another aspect of the invention, a method for completing a well for the production of fluids from sediments is also provided. The method includes the steps of: (i) introducing a first fluid and a second fluid of different densities into the wellbore, wherein the first fluid has a pressure gradient along the fluid pathway greater than the fracture extension pressure gradient of the sediments to be fractured and (ii) positioning an interface between the first and second fluids adjacent to the sediments to be fractured to produce a sufficient fluid pressure on the sediments to form a fracture in the sediments. As a typical example, the sediments may have a fracture extension pressure gradient of about 0.85 psi/ft. The pressure gradient of the first fluid preferably ranges from about 1.0 to about 1.3 psi/ft. The pressure gradient of the second fluid preferably ranges from about 0.25 psi/ft to 0.44 psi/ft.

The present invention can provide an inexpensive method for fracturing multiple zones in a well by reducing the number and complexity of steps and the time and cost required to complete a well. Unlike existing fracturing techniques, the present invention can provide a continuous process for fracturing multiple zones. Such a continuous process does not require each zone to be isolated from other zones and fractured independently, as in existing techniques. The present invention can complete a well with a large multiplicity of producing zones in less than a day, even in as little as 2 to 3 hours. The rapid completion rate significantly reduces the amount of liquid introduced into the zones. The present invention can fracture multiple zones in an open wellbore and thereby does not require the production casing to be cemented or otherwise attached to the walls of the wellbore. The second fluid acts to prevent fracturing of zones distant from the interface. The use of the second fluid eliminates the need for a bridge plug, straddle packers or sand or another granulated material to seal such zones and the attendant delays and costs associated therewith.

The present invention can fracture zones, even very thick (tall) zones (e.g., about 3000 to 8000 feet thick), substantially uniformly across the face of the zone. This results in higher rates of productivity for such zones than for zones fractured by existing methods.

The present invention can also provide a method for filling a fracture with a sufficient amount of proppant to increase the permeability of the fracture. The movement of the interface causes the fractures to be filled with proppant and sanded off by the gradual decrease in fluid pressure at the fracture. Additionally, the third and fourth fluids can be employed to sequentially fill the fracture with proppant of increasing median sizes. Unlike existing well completion techniques, the present invention has a reduced amount of excess proppant to be removed from the well after well completion. In the present invention, the excess proppant from filling the fracture in one zone is used to fill the fracture in the next adjacent zone.

DETAILED DESCRIPTION

The present invention provides a method for fracturing sediments containing a plurality of subterranean zones by traversing an interface between two different fluid columns across the sediments. This is accomplished by defining a fluid pathway along which the fluids can travel that includes the sediments. The pressure at any point along the fluid pathway is determined by the position of the interface along the fluid pathway.

An important aspect of the invention is the use of a first fluid having a pressure gradient along the fluid pathway greater than and a second fluid having a pressure gradient along the fluid pathway less than the fracture extension pressure gradient of the sediments to be fractured. In this manner, the first fluid can generate the pressures required to form fractures in the sediments. In contrast, the second fluid will have only a limited ability to fracture the sediments. Thus, the second fluid reduces fracturing of the sediments below the interface during fracturing of the sediments above the interface by the first fluid.

Another important aspect of the present invention is the fracturing of sediments not only in the porous zones but also in the sediments between the porous zones. In one aspect of the invention, substantially the entire length of the wellbore below the casing is fractured. In this manner, the fracturing of multiple zones is effected by a continuous process without the need to isolate the individual zones.

The present invention is applicable to any well that is used to collect valuable fluids from one or more subterranean zones. The valuable fluids can be a gas, such as natural gas, or a liquid, such as oil or water. The zones can be any sediments or portion(s) thereof that contain the valuable fluids. The present invention is particularly applicable to tight-sand sediments acting as reservoirs for oil and/or gas deposits.

Figure 1:
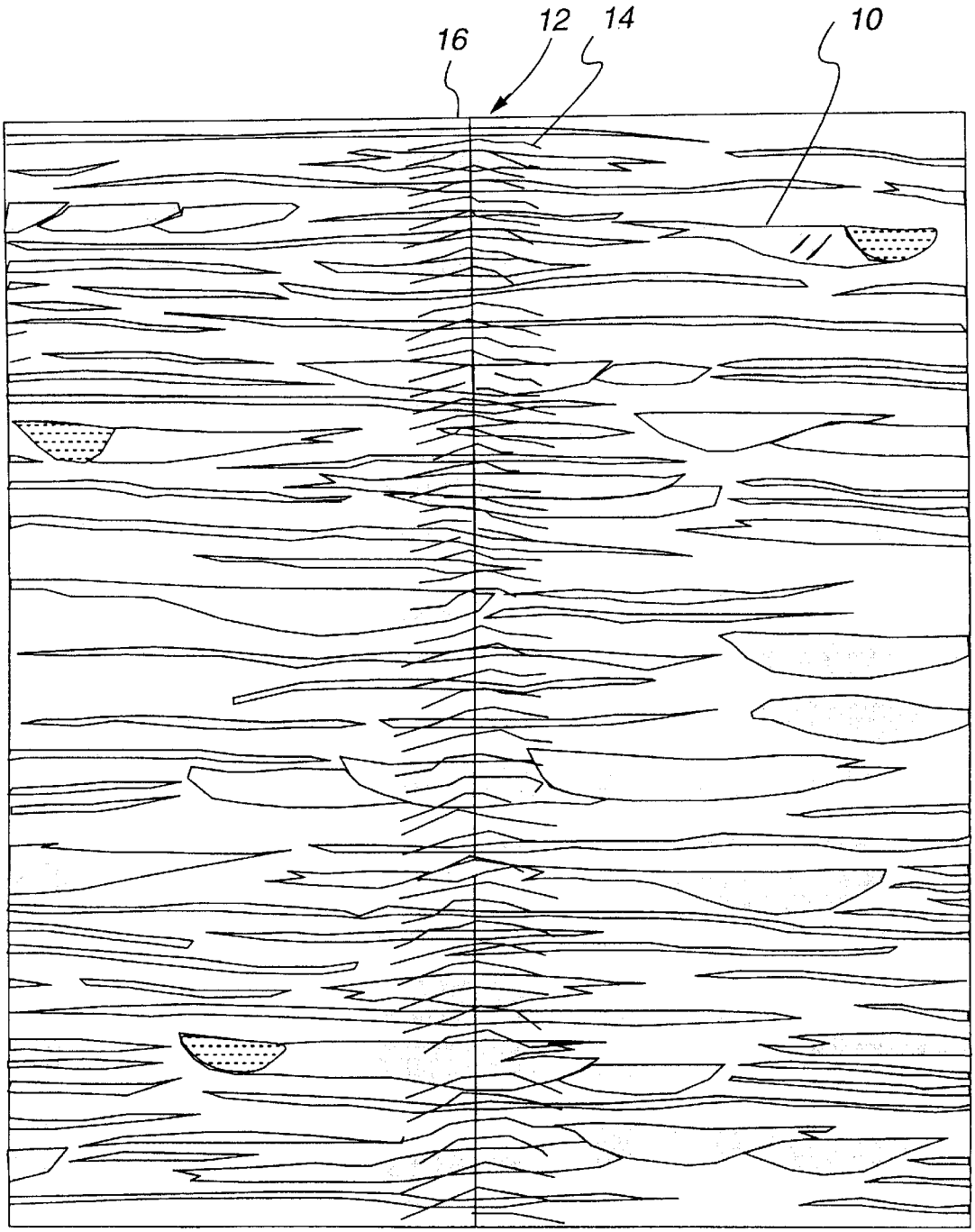
FIG. 1 depicts a well according to the present invention in tight sand sediments.

FIG. 1 depicts a well according to the present invention in tight-sand sediments. The stringers 10 are fluvial sandstone deposits formed generally at the inner bank of a stream or river. The stringers 10 are at varying depths in the well 12. Fractures 14 extend from the well 12 into the stringers 10 along substantially the entire length of the well 12 below the cemented well head or upper casing 16. The valuable fluids in the stringers 10 migrate along the fractures 14 to the well 12 for collection.

Figure 2:
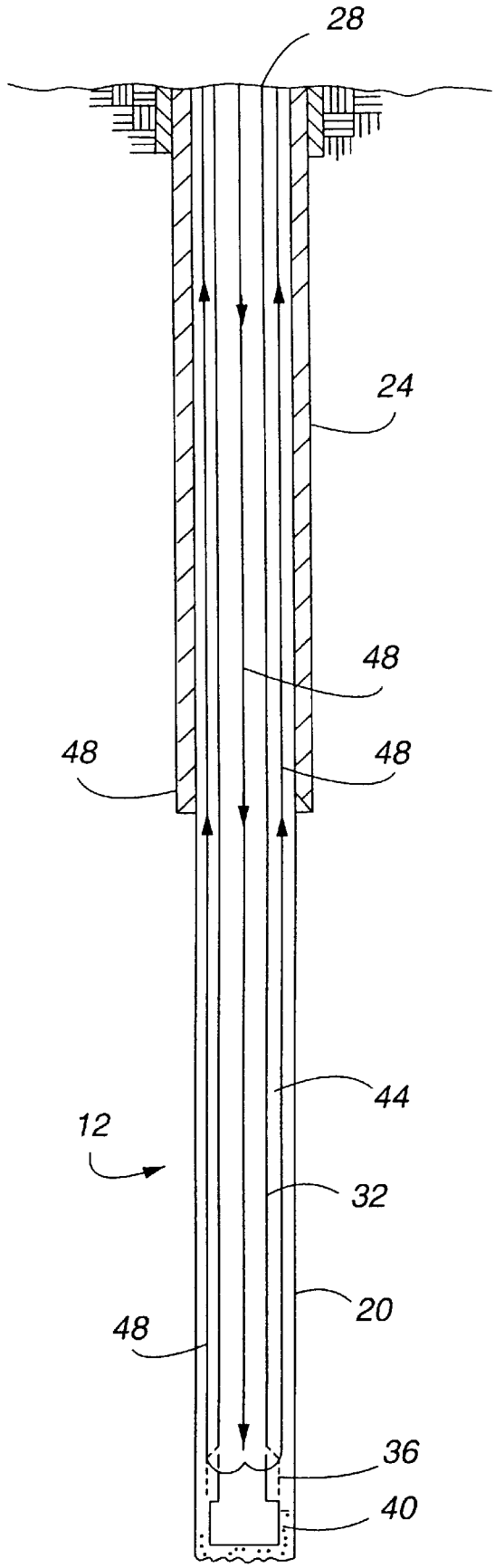
FIG. 2 depicts a well according to a first configuration of the present invention.
Figure 3:
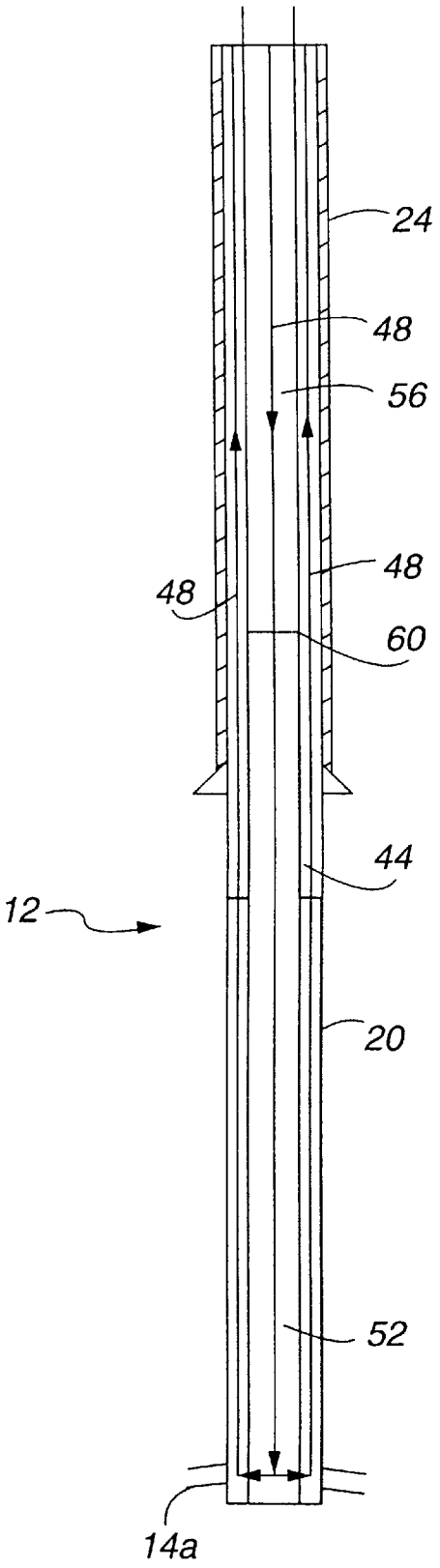
FIG. 3 depicts a well according to another configuration of the present invention.

FIGS. 2 and 3 depict the preferred configurations of the well 12 for the fracturing of one or more zones. The well 12 includes a wellbore 20, a well head casing 24, a well head 28, a conduit or production casing 32, a gravel-pack screen 36, and a sump 40. The wellbore 20 generally has a diameter ranging from about 7 to about 15 inches. The well head casing 24 generally has a diameter ranging from about 10 to about 14 inches and is attached (e.g., cemented) to the wall of the wellbore 20. The well head 28 is supported by the well head casing 24.

The conduit 32 in well 12 is any suitable structure for transporting a fluid, particularly a slurry. An example is a casing or tubing string. The conduit 32 has a diameter that is less than the wellbore diameter, typically ranging from about 4 to about 8 inches. The conduit 32 is attached to the well head 28 and is preferably not attached (e.g., cemented) to the wellbore 20 so that an open annulus 44 exists between the wellbore 20 and the conduit 32.

The gravel-pack screen 36 in the well 12 should have a pore size that allows very fine grained particles to pass but prevents passage of larger solid particles.

The sump 40 in the well 12 is a structure or open hole sump below the conduit 32 into which casing wiper plugs and other devices used during fracturing of the zone(s) can fall and not obstruct future operations. The sump can be any suitably sized container, such as a length of pipe or tubing, or just the open hole below the conduit. The sump 40 should have an inner diameter that is no less than the diameter of the conduit 32.

The well 12 further includes a fluid pathway 48 formed by the conduit 32 and wellbore 20 or upper casing 24. The fluid pathway 48 extends from the well head 28 through the conduit 32 and the annulus 44 back to the well head 28. The conduit 32 communicates with the annulus 44 only at or below the deepest sediments to be fractured.

The fluid pathway 48 in the well 12 includes a first fluid 52 and a second fluid 56 which contact at an interface 60. The first and second fluids 52, 56 produce along the fluid pathway 48 a fluid pressure on the sediments adjacent to the interface 60 that is sufficient to cause fracturing of the sediments. As will be appreciated, the magnitude of the fluid pressure on the sediments at the interface 60 and the fluid pressure profile exerted against the sediments are directly related to the amount of first fluid 52 located in the annulus 44 above the interface 60. As shown in FIG. 3, the zones and other sediments are fractured as the interface 60 traverses the distance between the wellbore bottom and the upper cemented casing 24.

As noted above, the first fluid 52 is preferably any fluid having a pressure gradient along the fluid pathway significantly greater than the average gradient of the fracture extension pressures of the sediments to be fractured. The fracture extension pressure gradient of the sediments is generally between about 0.7 and about 0.9 psi/ft. Preferably, the pressure gradient of the first fluid 52 is no less than about 1.0 psi/ft and more preferably from about 1.2 to about 1.3 psi/ft.

The first fluid 52 includes a slurry of heavy solid particles to produce the desired high pressure gradient and density. The solid particles in the slurry preferably have a specific gravity no less than about 4.5. More preferably, the specific gravity of the solid particles ranges from about 4.9 to about 5.2. Suitable solid particles include very finely crushed taconite, galena, magnetite, steel shot, and derivatives and mixtures thereof.

The first fluid 52 can include a salt to reduce the hydration and swelling of clay in the wellbore 20 and cause the attachment of the clay to the walls of the mineral grains. Hydration and mobility of the clay can cause more space plugging of the tight sand pore throats.

The second fluid 56 is preferably any fluid having a pressure gradient along the fluid pathway substantially less than the average gradient of the fracture extension pressures of the sediments to be fractured. Preferably, the pressure gradient of the second fluid 56 is less than about 0.45 psi/ft and more preferably from about 0.25 to about 0.44 psi/ft.

The second fluid 56 may be a foam containing a compressible fluid. The second fluid 56 desirably includes a compressed gas, such as air, nitrogen, natural gas, and mixtures thereof, and a liquid, such as water, or oil, and mixtures thereof.

Figure 5:
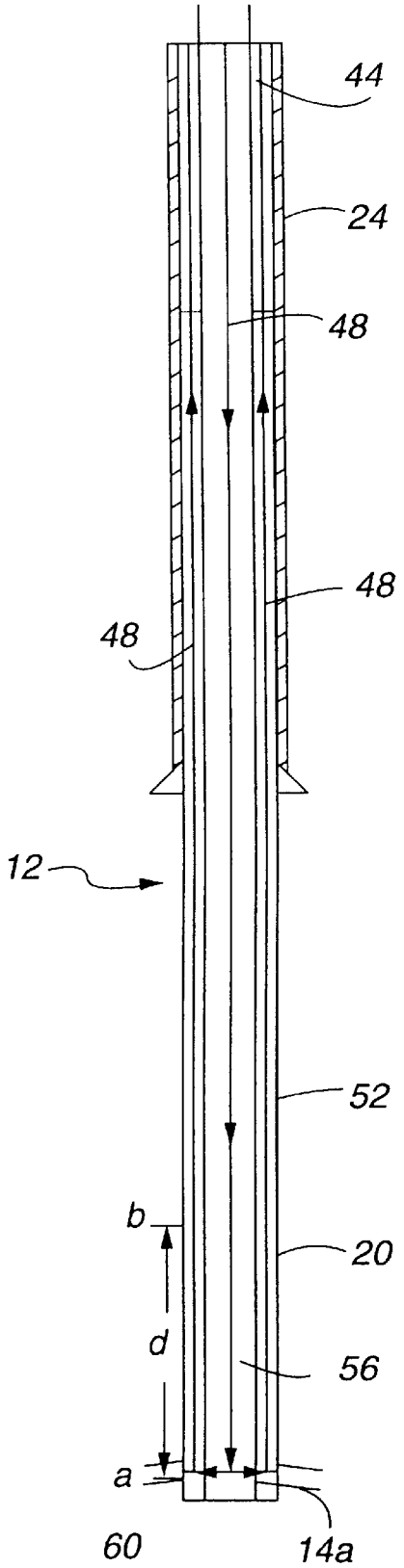
FIG. 5 depicts a well according to yet another configuration of the present invention.
Figure 4:
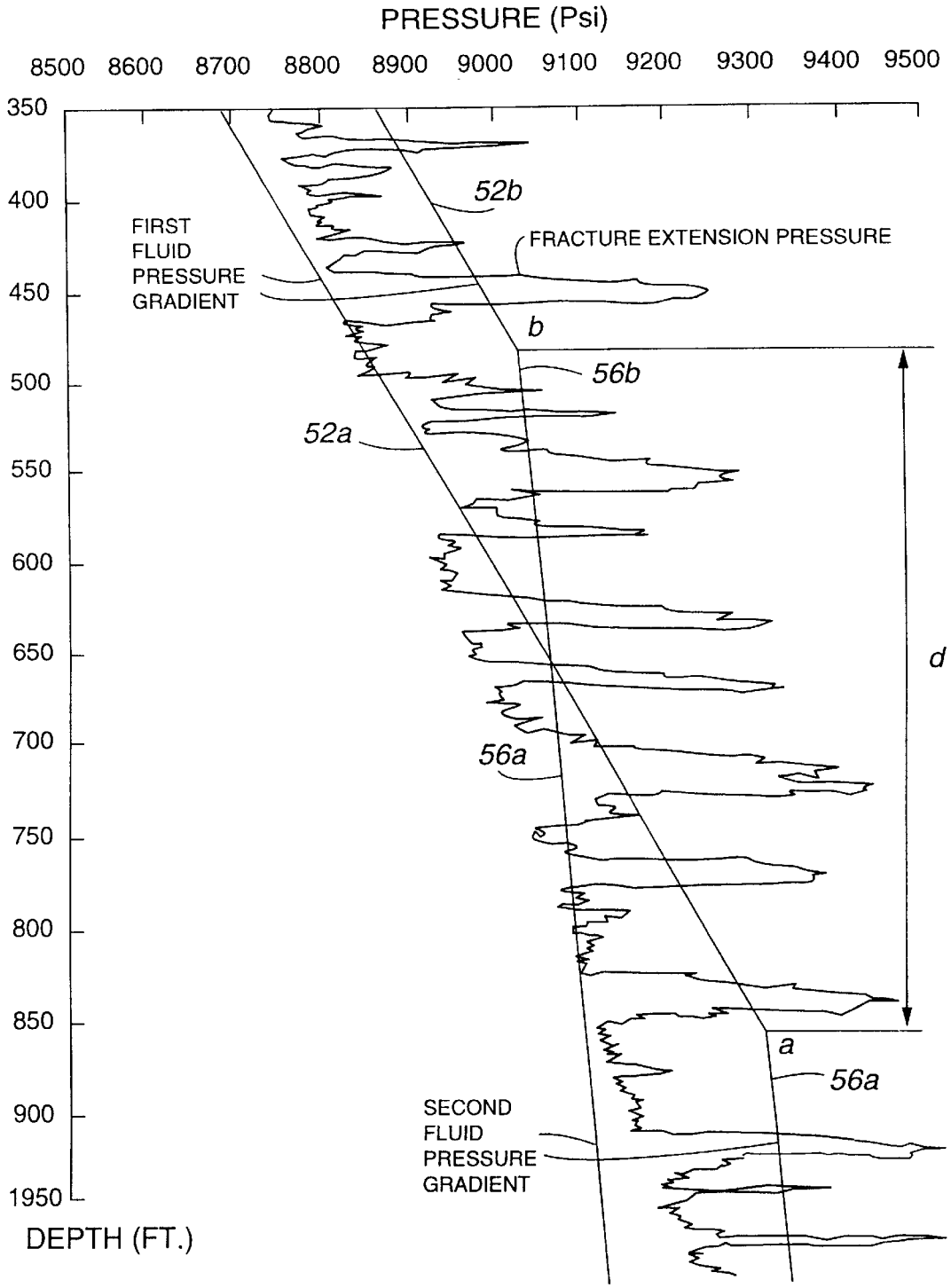
FIG. 4 is a graph of depth versus pressure depicting the fracturing of a portion of the sediments.

Referring to FIGS. 4 and 5, the fracturing of the sediments by the first and second fluids 52, 56 will now be described. FIG. 4 illustrates the fracture extension pressure of the sediments as a function of depth. The line representing the relationship between the average fracture extension pressure of the sediments and depth is known as the fracture extension pressure gradient of the sediments. FIG. 4 further illustrates the pressure gradients of the first and second fluids 52, 56 at different positions of the interface 60 along the fluid pathway. When the interface 60 is at point "a", the pressure gradient of the first fluid 52*a* intersects the pressure gradient of the second fluid 56*a* at point "a". The location of point "a" on FIG. 4 depends upon the depth of point "a" and the total fluid pressure exerted on the sediments at point "a". At point "a", the first fluid 52*a* fractures the portions of the sediments having a fracture extension pressure falling to the left of the pressure gradient of the first fluid 52*a*. In other words, the first fluid 52*a* will fracture any sediments having a fracture extension pressure less than the pressure exerted on the sediments by the first fluid 52*a*. Likewise, the second fluid 56*a* fractures the portions of the sediments having a fracture extension pressure gradient falling to the left of the pressure gradient of the second fluid 56*a*. Neither the first fluid 52*a* nor the second fluid 56*a* will fracture portions of the sediments having a fracture extension pressure greater than the fluid pressure of the fluid exerted on the sediments.

As the interface 60 traverses the distance "d" from point "a" to point "b", the rate of fracture extension in the horizontal direction of the sediments at point "a" decreases. At point "b", the sediments being fractured by first fluid 52*b* and second fluid 56*b* are located at shallower depths than the sediments fractured by first fluid 52*a* and second fluid 56*a*. As the interface 60 moves upward towards point "b", the pressure exerted on the deeper sediments will decrease. As a consequence, the movement of the interface 60 along the fluid pathway 48 determines not only what sediments will be fractured and extended but also the fluid pressure at a given point along the fluid pathway 48.

In this manner, the interface 60 can be moved from the bottom of the wellbore 20 to the highest zone to be fractured, thereby sequentially fracturing all of the sediments, located along the wellbore 20. As shown in FIG. 1, the extensive fracturing along substantially the entire length of the wellbore 20 is particularly advantageous in tight-sand sediments, where isolated stringers 10 contain the oil and/or gas to be collected by the well.

The steps according to the present invention for fracturing the sediments will now be described. The steps provide not only a technique to fracture sediments, including one or more zones, but also techniques to fill the fractures with proppant and to gravel pack the well.

Referring to FIGS. 2 and 3, to prepare the well 12 for the first and second fluids 52, 56, a cleaning fluid (not shown) can be injected into the conduit 32 behind a casing wiper plug. The cleaning fluid scours the walls of the wellbore 20 and displaces and removes mud in the wellbore 20. The cleaning fluid can be any fluid containing an abrasive material, such as a crushed hard rock or minerals.

After well preparation, the first fluid 52 is introduced into the fluid pathway 48 through the conduit 32. A casing wiper plug is preferably inserted in the conduit 32 before introduction of the first fluid 52. As depicted in FIG. 3, the first fluid 52 will move to the bottom of the wellbore 20, displacing the cleaning fluid and causing fractures 14*a* to form at the bottom of the wellbore 20. The displaced cleaning fluid in the annulus 44 is preferably removed from the fluid pathway 48 through the well head 28.

The amount of first fluid 52 introduced into the wellbore 20 through the conduit 32 depends upon the depth of the well 12 and the desired length, width and height of the fracture 14. As noted above, the magnitude of the fluid pressure on the sediments at the interface 60 and the fluid pressure profile exerted against the sediments are directly related to the amount of first fluid 52 located in the annulus 44 above the interface 60.

Referring to FIGS. 3 and 5 after introduction of the first fluid 52, the second fluid 56 is introduced into the fluid pathway 48. As in the introduction of the first fluid 52, a casing wiper plug is preferably inserted in the conduit 32 before introduction of the second fluid 56. As the second fluid 56 is introduced into the conduit 32, the first fluid 52 will be displaced into the annulus 44, and the interface 60 will move towards the bottom of the well 12.

Figure 6:
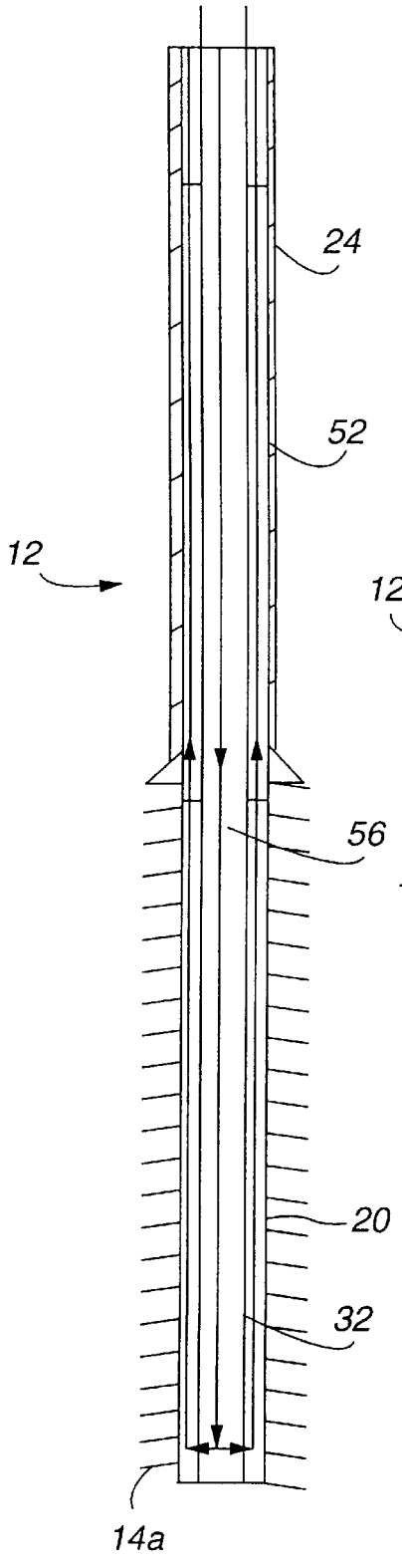
FIG. 6 depicts a well according to a further configuration of the present invention.

Referring to FIG. 6, a sufficient amount of the second fluid 56 should be introduced into the conduit 32 to cause the interface 60 to move via the annulus 44 from the bottom of the well 12 to the top of the sediments to be fractured, which in this case is located at the bottom of the cemented upper casing 24. In this manner, the interface 60 traverses substantially the entire distance of the wellbore 20 below the cemented upper casing 24, fracturing the sediments located adjacent to the wellbore 20.

During the traverse of the interface 60 in the annulus 44 along the wellbore 20, it is important to monitor the position of the interface 60. The preferred method for monitoring the interface position is by monitoring the fluid pressure at a plurality of points in the fluid pathway 48, preferably in the annulus 44. Alternatively, the interface position can be estimated by a sonic or echo meter that uses sonic waves to locate the top of the first fluid column in the annulus 44.

Because of the loss of the first and second fluids into the fractures 14*a*, during fracturing the first fluid 52 can be introduced into the annulus 44 and the second fluid 56 can be introduced into the conduit 32.

Based on the position of the interface 60, it may be necessary to adjust the relative introduction rates of the first and second fluids 52, 56 so that the interface 60 traverses the sediments at a desired rate.

In one embodiment, the interface position is controlled by introducing the first fluid 52 in the annulus 44 at a variable rate and the second fluid 56 in the conduit 32 at a relatively constant rate. With the rate of introduction of the second fluid 56 being substantially fixed, the variable introduction rate of the first fluid 52 can be determined based on the position and traverse rate of the interface 60.

Figure 7:
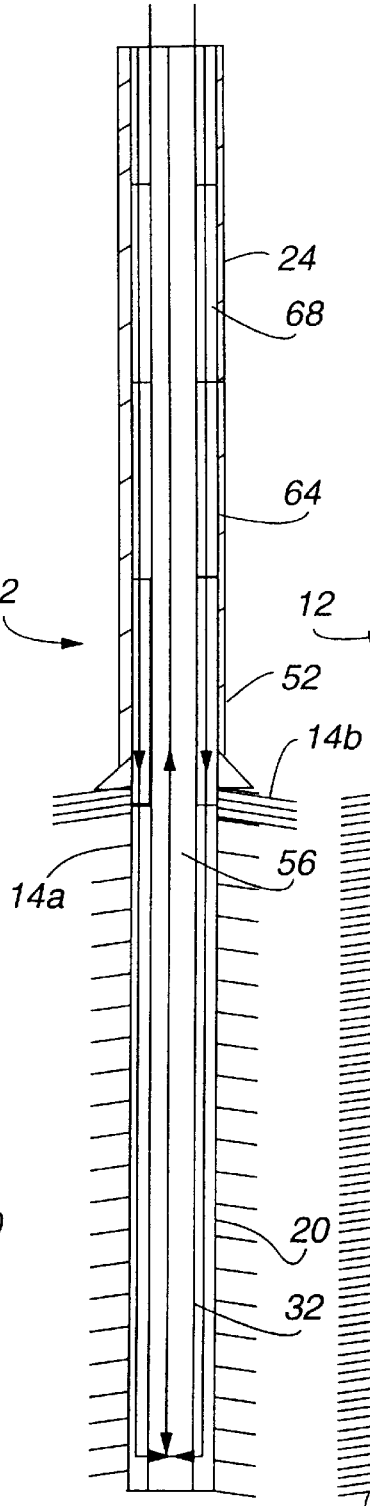
FIG. 7 depicts a well according to a further configuration of the present invention.
Figure 8:
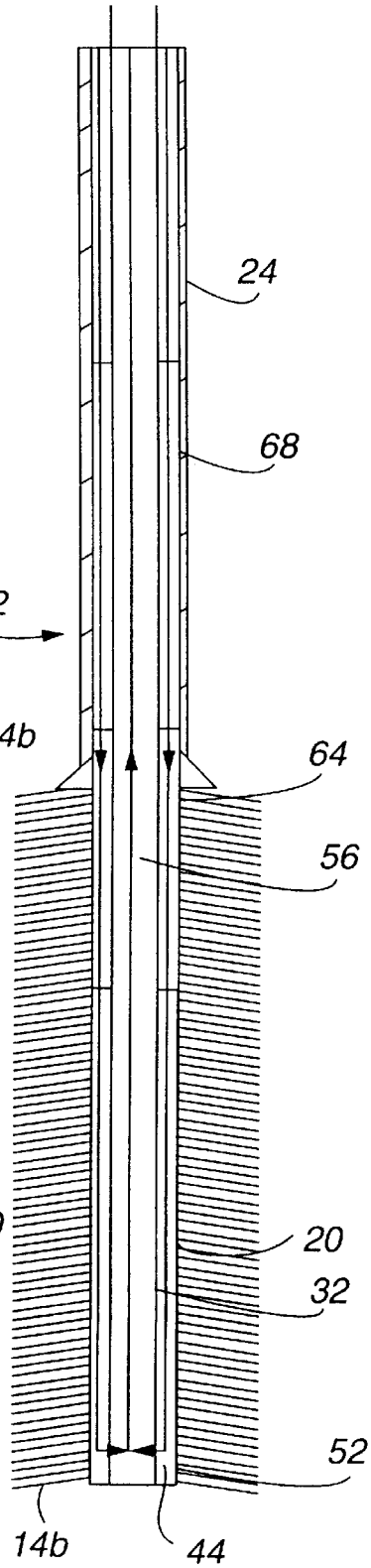
FIG. 8 depicts a well according to a further configuration of the present invention.

Referring to FIGS. 6 through 8, to complete the well 12, the interface 60, which is now located above the sediments to be fractured, can be moved to the bottom of the wellbore 20 by pumping down the annulus 44 a third and fourth fluid 64, 68. While not wishing to be bound by any theory, it is believed that during the second (downward) traverse of the interface 60, the fractures 14*a* are extended farther from the well bore and enlarged to a wider width illustrated in 14*b*. During the second traverse, the fractures 14*b* are filled with particles of different median sizes to yield the desired permeability for the sediments, and the annulus 44 is gravel-packed. As discussed below, the second traverse uses the third and fourth fluids 64, 68, which were not used in the first traverse.

The third fluid 64 has a density different from the densities of the first and second fluids 52, 56 and can be introduced into the annulus 44 to extend and prop open the fractures 14. The third fluid 64 preferably contains coarser or larger proppant grain sizes than the first and second fluids.

The fourth fluid 68 has a density different from the first, second, and third fluids 52, 56, 64 and can be introduced into the annulus 44 to gravel pack the annulus 44 and further enlarges the fracture. The proppant grain sizes in the fourth fluid are larger than in the third fluid.

It is preferred that the third fluid 64 be introduced into the annulus 44 before the fourth fluid 68. In this manner, proppant from the various fluids will flow into the fractures 14 in order of size, from smallest to largest. The sequential packing of the fractures 14 based on proppant size will result in fractures of high permeability.

As noted above in connection with the first traverse, it is important to monitor the position of the interface 60 during the second traverse. It may be necessary to control the rate of input of the third or fourth fluids 64, 68 into the well 12 and/or the rate of input or output of the second fluid 56 into or out of the well 12 to cause the interface 60 to traverse the sediments at the desired rate.

Figure 9:
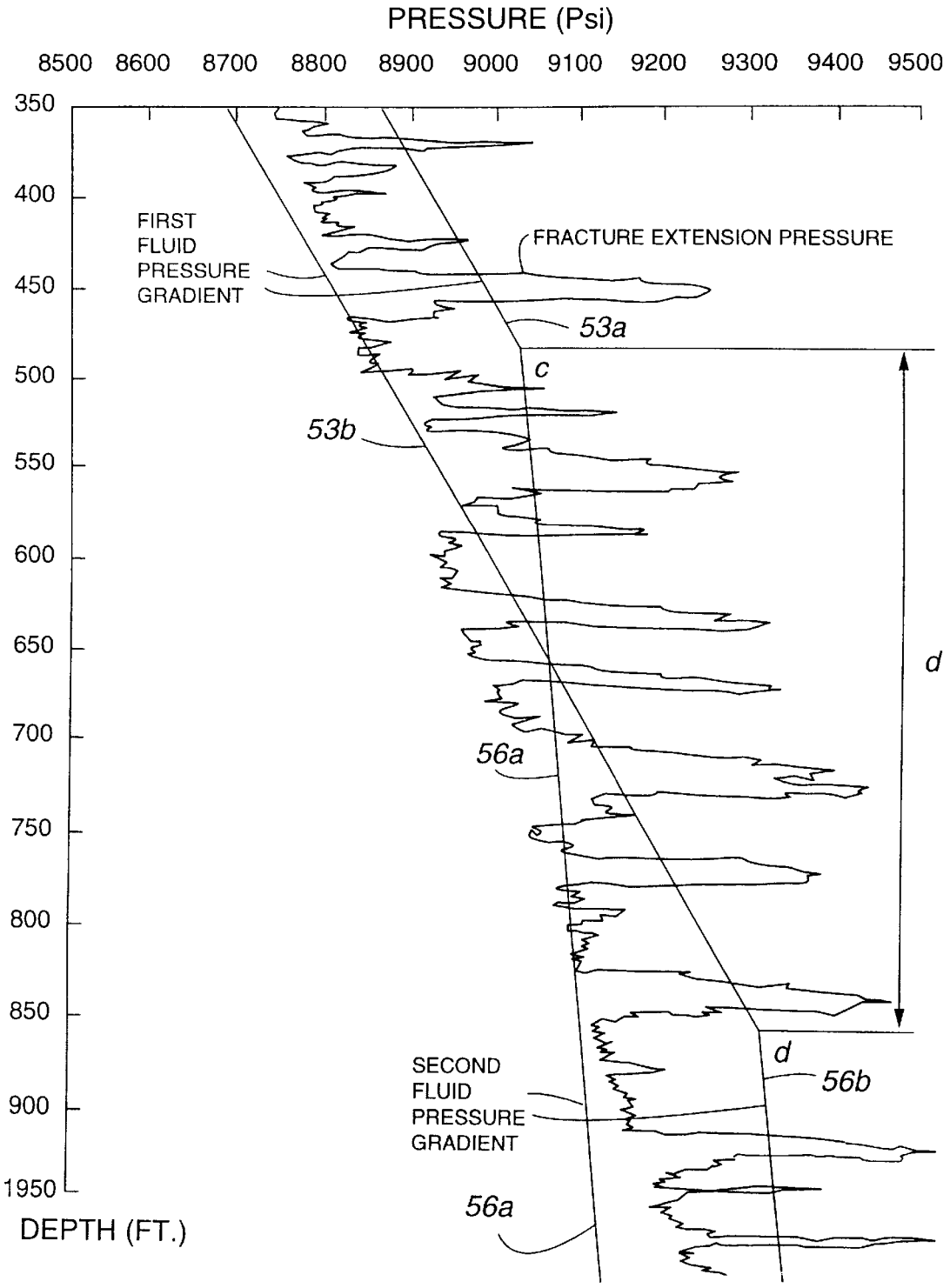
FIG. 9 is a graph of depth versus pressure depicting the fracturing of a portion of the sediments.

FIG. 9 illustrates the fracturing mechanism during the second (downward) traverse of the interface 60 at selected points in the traverse. When the interface 60 is at point "c", the average pressure gradient of the first, third, and fourth fluids 53*a* along the fluid pathway causes fracturing of the sediments having a fracture extension pressure to the left of the average pressure gradient 53*a*. The second fluid 56*a* causes fracturing of the sediments having a fracture extension pressure gradient to the left of the pressure gradient of the second fluid 56*a*. When the interface 60 is at point "d", the average pressure gradient of the first, third, and fourth fluids 53*b* along the fluid pathway and the pressure gradient of the second fluid 56*b* along the fluid pathway causes fracturing of deeper sediments than when the interface 60 is at point "c". As in the first traverse, none of the fluids will fracture portions of the zone having a fracture extension pressure greater than the fluid pressure exerted against the sediments.

The use of three fluids having different pressure gradients along the fluid pathway and median proppant sizes produces fractures of a high permeability. While not wishing to be bound by any theory, it is believed that, as the interface 60 moves past a given fracture position 14, the fracture 14 is opened wider and extended horizontally by the high fluid pressure exerted on the fracture by the first, third and fourth fluids 52, 64, 68 to form the fractures 14*b*, which are sequentially filled with the proppant: of the third and fourth fluids 52, 64, 68. As the distance between the downward traversing interface 60 and the fracture location 14 increases, the fluid pressure at the fracture 14 decreases. As the fluid pressure decreases, the velocity of flow of the first, third, and/or fourth fluids 52, 64, 68 into the fracture 14 decreases, causing sand-off of the fracture 14 to occur. As a consequence of the gradual decrease in fluid pressure at such fracture location 14 as the interface 60 moves away from the fracture location 14, the fractures are substantially completely filled (packed) with proppant.

Referring to FIG. 2, when the interface 60 reaches the gravel-pack screen 36, the gravel-pack screen 36 passes the first and second fluids 52, 56 which are substantially free of proppant but not the third and fourth fluid 64, 68 which contain proppant. The pore size of the gravel-pack screen 36 is smaller than the median size of the proppant in the fourth fluid 68. Accordingly, the proppant collects in the annulus 44, thereby causing gravel packing of the annulus 44 and the fracture 14 to occur.

The proppant in the annulus 44 can be resin treated and cured in the annulus 44 to consolidate the gravel-pack. The consolidation of the gravel-pack will permit subsequent perforation at one or more entry points without the need for additional, gravel-packing screens across the perforations.

To collect the various fluids and initiate production testing, the first, second, third and fourth fluids 52, 56, 64, 68 should be withdrawn through the conduit 32. The oil and/or gas in the zone(s) will then flow from the fractures 14, through the gravel-packed annulus 44 and into the well 12 for collection. After unloading the fluids and making initial production tests, the well 12 can be shut in, and the drilling-rig, or completion rig, moved off location for preparation for production into the pipeline.

EXAMPLE

A well was drilled in a series of stages. In the first stage, the wellbore was drilled to a depth of 700 ft and a 13⅜ inch casing was cemented in the wellbore. In the next stage, a 12¼ wellbore was drilled to a depth of 7,500 ft. A 9⅝ inch casing was cemented in the hole from a depth of 7,500 ft depth to the surface. In another stage, either an 8½ inch or 8¾ inch wellbore was drilled from a 7,500 ft depth to a 15,000 ft depth. After logging of the wellbore, a 5½ inch casing was positioned in the wellbore that extended from the 15,000 ft depth to the surface. The casing was positioned using a 7.625 inch outer diameter float shoe and float collar with extra large fluid transmission passageways. The casing was not cemented in the wellbore.

Below the 5½ inch casing, a 30 ft long gravel-pack screen and a 30 ft length of 7⅝ inch casing were positioned. The gravel-pack screen had an inner diameter of 5.5 inches or larger and an outer diameter not to exceed 7.625 inches. The gravel-pack screen allowed all solids smaller than 30 mesh to pass through the screen but not solids larger than 30 mesh. The 30 ft length of casing captured wiper plugs ejected through the bottom of the 5½ inch casing during fracturing. The wiper plugs fell through the gravel-pack screen and collect in the bottom of the 30 ft length of casing.

A No. A-1 casing wiper plug was inserted into the 5½ inch casing and a cleaning fluid injected into the casing behind the plug. The cleaning fluid was a nitrogen-foam fracturing fluid at about 0.627 psi/ft. pressure gradient along the wellbore and a volumetric composition of about 50% nitrogen gas at 9,000 psi and 200° F., 23% water and 27% proppant of about 80–120 mesh (Tyler). The proppant was taconite having a 3.5 specific gravity. The cleaning fluid was injected at about 50 barrels/minute until about 700 barrels of the cleaning fluid was in the wellbore.

After preparation of the well with the cleaning fluid, the first fluid was introduced into the casing behind a No. A-2 casing wiper plug. The first fluid had a pressure gradient in the wellbore of approximately 1.3 psi/ft. and was a gelled-water/taconite slurry with a volumetric composition of about 46% of water solution, and about 54% taconite of 300–400 mesh size and 4.9 specific gravity. The first fluid was injected into the casing at a rate of about 50 barrels/minute until about 400 barrels of the first fluid were in the wellbore.

A No. A-3 casing wiper plug was inserted into the casing and the second fluid was injected into the wellbore. The second fluid had a pressure gradient in the wellbore of approximately 0.22 psi/ft and was a nitrogen-foam frac fluid with a volumetric composition of 60% nitrogen gas at 9,000 psi and 200° F. and 40% water. The second fluid was injected into the casing at a rate of about 50 barrels/minute until about 1,000 barrels of the second fluid was in the wellbore.

After injecting 315 barrels of the second fluid, more of the first fluid was simultaneously injected down the annulus (between the 5½ inch casing and the 9⅝ inch casing) at a rate of 50 barrels/minute until about 1,000 barrels of the first fluid was introduced.

To fracture the sediments to be fractured, the interface between the first and second fluids traversed the sediments. The pressure at various points in the annulus was monitored to track the time progression of the interface across the sediments. The relative injection rates of the first fluid in the annulus and the second fluid in the casing were varied such that the interface traversed the 7,500 ft completion zone at a uniform rate of about 375 ft/minute, or about 3.75 ft/barrel of combined first and second fluids.

To extend and prop open the fractures formed by the first and second fluids, an additional 3,000 barrels of the second fluid and the third fluid were injected into the wellbore. The third fluid was injected into the annulus at a rate of 50 barrels per minute until about 3,000 barrels of the third fluid were in the annulus. The third fluid had a pressure gradient in the wellbore of 1.088 psi per ft (or heavier). The third fluid was a gelled-water taconite slurry with a volumetric composition of about 46% of water solution and 54% taconite of 40–60 mesh size and 3.5 specific gravity. The various fluids described above create a continuous 7,500 ft high (tall) by 0.3 inch to 0.5 inch wide fracture with an average horizontal length of about 200 ft.

To gravel-pack the annulus in the completion zone, a fourth fluid was injected into the annulus at a rate of 50 barrels per minute until about 450 barrels of the fourth fluid was in the annulus. The fourth fluid had a pressure gradient in the wellbore of 1.00 psi per ft (or heavier). The fourth fluid contained a 12–20 mesh taconite proppant with a 3.5 (or higher) specific gravity. The fourth fluid consisted of gelled water with a volumetric composition of about 50% of water solution and 50% of the taconite proppant. After injecting about 450 barrels of the fourth fluid into the annulus, the injection of the second fluid down to the casing was terminated. The second fluid being lighter than the fourth fluid decompressed by flowing back up the casing. At this point, most or all of the annulus-injected third fluid was injected into the sediments and the fourth fluid arrived at the gravel-packing screen at the bottom of the well. The gelled water from the fourth fluid flowed through the gravel-packing screen and into the casing area where the pressure was decreasing by the decompression of the second fluid. By this process, the annulus area throughout the 7,500 feet of open wellbore was effectively gravel-packed with 12–20 mesh crushed taconite. The crushed taconite was resin treated and cured in the annulus to create a gravel-packed consolidation. The 12–20 mesh gravel-packed resin consolidation permitted perforation of the casing at a multiplicity of entry points without the need for additional, gravel-packing screens across those perforations.

To flow back the various fluids and initiate production testing, the decompression of the second fluid was continued via a reverse flow of the first, third and fourth fluids into and up the casing. After the gelled water from the fourth fluid was produced from the annulus through the gravel-pack screen and casing, the various fluids in the formation fractures were produced into and up the casing. Gas was then produced through the 40–60 mesh propped fractures, through the 12–20 mesh annulus gravel-pack, through the gravel-pack screen, and then up through the 5½ inch casing to the well head.

SUMMARY OF COMPLETION PROCESS:

| Fluid | Total Volume (bbls) | Water (bbls) | Taconite Tons 300–400 | 40–60 | 12–20 |
|---|---|---|---|---|---|
| Cleaning Fluid | 700 | 158 | 118 | — | — |
| First Fluid | 400 | 184 | 182 | — | — |
| Second Fluid | 2,000 | 950 | 454 | — | — |
| Third Fluid | 6,000 | 2,850 | | 1,012 | — |
| Fourth Fluid | 450 | 200 | | — | 152 |
| Tot = (= 1.87 hrs) | 9,550 | 4,342 | 754 | 1,012 | 152 |

While various embodiments of the present invention have been described in detail, it is apparent that modifications and adaptations of those embodiments will occur to those skilled in the art. However, it is to be expressly understood that such modifications and adaptations are within the scope of the present invention, as set forth in the following claims.

What is claimed is:

1. A method for completing a well for the collection of fluids from a plurality of subterranean zones at different depths, the well having a wellbore extending from an accessible upper end through the plurality of zones with a conduit positioned in the wellbore to define a fluid pathway including the conduit and an area between the conduit and the wellbore, comprising the steps of:

introducing a first fluid having a first density into the fluid pathway;

introducing a second fluid having a second density different from the first density into the fluid pathway, wherein the first and second fluids produce within the wellbore a first fluid pressure on a first zone adjacent to an interface between the first and second fluids with the first fluid pressure being sufficient to form a fracture in the first zone; and changing the position of the interface to a location along the fluid pathway adjacent to a second zone to produce a second fluid pressure on the second zone with the second fluid pressure being sufficient to form a fracture in the second zone.

2. The method, as claimed in claim 1, further comprising:

sediments containing the plurality of subterranean zones; and wherein:

the first fluid has a pressure gradient along the fluid pathway that is greater than the fracture extension pressure gradient of the sediments to be fractured.

3. The method, as claimed in claim 1, wherein:

the first fluid comprises clay and a bivalent or trivalent cation to dehydrate the clay.

4. The method, as claimed in claim 1, further comprising:

sediments containing the plurality of subterranean zones; and wherein:

the second fluid has a pressure gradient along the fluid pathway that is less than the fracture extension pressure gradient of the sediments to be fractured.

5. The method, as claimed in claim 1, wherein:

when the interface is positioned adjacent to the second zone, the fluid pressure on the first zone is less than the first fluid pressure.

6. The method, as claimed in claim 1, wherein:

when the interface is positioned adjacent to the second zone, the second fluid exerts a fluid pressure on the first zone that is insufficient to fracture the first zone.

7. The method, as claimed in claim 1, wherein the changing step comprises:

injecting the first fluid into the fluid pathway at a first rate; and injecting the second fluid into the fluid pathway at a second rate, wherein the first rate and second rate depend upon the desired position of the interface.

8. The method, as claimed in claim 7, wherein the changing step comprises:

injecting the first fluid into the area between the conduit and the wellbore; and injecting the second fluid into the conduit.

9. The method, as claimed in claim 1, wherein the changing step comprises:

monitoring the fluid pressure at a plurality of points in the fluid pathway to determine the position of the interface.

10. The method, as claimed in claim 1, wherein the changing step comprises:

first moving the interface from the first zone to the second zone: and second moving the interface from the second zone to the first zone, wherein the first zone is at a greater depth than the second zone.

11. The method, as claimed in claim 1, wherein the first fluid comprises solid particles having a median size and further comprising:

third introducing into the fluid pathway a third fluid having a density different from the first and second fluid densities, the third fluid comprising a third proppant having a third proppant median size greater than the solid particles median size.

12. The method, as claimed in claim 1, wherein the first fluid comprises solid particles having a median size ranging from about 300 to about 400 mesh (Tyler) and further comprising:

third introducing into the fluid pathway a third fluid having a third density different from the first and second densities, the third fluid comprising a third proppant having a median size ranging from about 40 to about 60 mesh (Tyler).

13. The method, as claimed in claim 12, further comprising:

fourth introducing into the fluid pathway a fourth fluid having a fourth density different from the first, second, and third densities, the fourth fluid comprising a fourth proppant having a fourth proppant median size ranging from about 12 to about 20 mesh (Tyler).

14. A system for fracturing a plurality of subterranean zones, comprising:

a wellbore extending from an accessible upper end into the zones to be fractured;

a conduit located within the wellbore, the conduit extending from the earth's surface to a location below the deepest zone to be fractured and communicating with an area between the wellbore and the conduit at a location at or below the deepest zone to be fractured to define a fluid pathway including the conduit and the area between the conduit and the wellbore, the fluid pathway contacting the portion of the zone to be fractured;

a first fluid positioned along the fluid pathway in the wellbore; and a second fluid positioned along the fluid pathway in the wellbore, the second fluid having a different density than the first fluid and forming an interface with the first fluid, wherein the fluid pressure exerted on the zones to be fractured is varied by altering the position of the interface along the fluid pathway.

15. The system, as claimed in claim 14, wherein:

the conduit is sealed from the area between the conduit and the wellbore above the deepest zone to be fractured.

16. The system, as claimed in claim 14, wherein:

the conduit comprises pipe having an outer diameter smaller than the diameter of the wellbore.

17. The system, as claimed in claim 14, wherein:

the conduit is detached from the wellbore.

18. The system, as claimed in claim 14, wherein the first fluid comprises solid particles having a median size and further comprising:

a porous surface at the bottom end of the conduit and in communication with the conduit, the porous surface having a pore size less than the median size of the solid particles.

19. The system, as claimed in claim 14, further comprising:

a container located below the conduit for collecting objects in the first and second fluids.

20. A method for completing a well for the production of fluids from sediments, the well having a wellbore extending from an accessible upper end into the formation with a conduit positioned within the wellbore to define a fluid pathway including the conduit and an area between the conduit and the wellbore, comprising the steps of:

introducing a first fluid and a second fluid of different densities into the wellbore, wherein the first fluid has a pressure gradient along the fluid pathway greater than the fracture extension pressure gradient of the sediments to be fractured; and positioning an interface between the first and second fluids adjacent to the sediments to be fractured to produce a sufficient fluid pressure on the sediments to form a fracture in the sediments.

21. The method, as claimed in claim 20, wherein:

the first fluid comprises a proppant having a median size ranging from about 300 to about 400 mesh (Tyler).

22. The method, as claimed in claim 20, wherein:

the second fluid has a pressure gradient along the fluid pathway that is less than the fracture extension pressure gradient of the sediments to be fractured.

23. The method, as claimed in claim 20, wherein the formation comprises a plurality of zones and the positioning step comprises:

first positioning the interface adjacent to a first zone in the sediments to produce a sufficient fluid pressure on the first zone to form a fracture in the first zone; and second positioning the interface adjacent to a second zone in the sediments to produce a sufficient fluid pressure on the second zone to form a fracture in the second zone.

24. The method, as claimed in claim 20, wherein:

the fluid pressure on the sediments depends upon the position of the interface along the fluid pathway.

25. The method, as claimed in claim 20, wherein the positioning step comprises:

first positioning the interface adjacent to the sediments to be fractured to form a fracture in the sediments with the first fluid flowing into the fracture at a first rate; and second positioning the interface at a distance from the sediments to be fractured with the first fluid flowing into the fracture at a second rate, wherein the first rate of flow is greater than the second rate of flow.

* * * * *